United States Patent [19]

Vatant

[11] Patent Number: 4,946,141

[45] Date of Patent: Aug. 7, 1990

[54] METAL PROCESSING CONVERTER

[75] Inventor: Robert Vatant, Saint-Chamond, France

[73] Assignee: CLECIM, Cergy Pontoise, France

[21] Appl. No.: 312,843

[22] Filed: Feb. 21, 1989

[30] Foreign Application Priority Data

Feb. 19, 1988 [FR] France ..... 88 02037

[51] Int. Cl.[5] ..... C21C 5/50

[52] U.S. Cl. ..... 266/246; 266/245

[58] Field of Search ..... 266/245, 246, 276, 243

[56] References Cited

U.S. PATENT DOCUMENTS

| | | | |
|---|---|---|---|
| 1,123,868 | 1/1915 | Haas | 266/245 |
| 3,144,496 | 8/1964 | Langlitz | 266/245 |
| 3,548,678 | 12/1970 | Phillips | 266/245 |

FOREIGN PATENT DOCUMENTS

| | | |
|---|---|---|
| 1501288 | 11/1966 | France . |
| 1550338 | 12/1968 | France . |
| 2236943 | 2/1975 | France . |
| 0039684 | 1/1961 | Luxembourg . |

*Primary Examiner*—S. Kastler

*Attorney, Agent, or Firm*—Pollock, Vande Sande & Priddy

[57] ABSTRACT

The invention relates to a converter comprising a vessel (1) resting on two supports (2) by means of two rotational bearing members (3) located diametrically opposite to each other and centered on the same tilting axis (15).

According to the invention, the two bearing members of the vessel (1) consist respectively of two collars (3, 3') with a fairly large diameter, which bear against rollers (5) and which form an integral part of the vessel (1), each collar (3, 3') being fixed directly onto the side wall of the vessel along its internal edge (31); the diameter of the collar (3) being determined so that a connection over a sufficient length is ensured.

The invention relates especially to the manufacture of steel.

14 Claims, 4 Drawing Sheets

1
11
36
3
45
32
37
33
62
6
15
61
62
31
66
65
64
38
53
43
51
2

METAL PROCESSING CONVERTER

FIELD OF THE INVENTION

The invention relates to a new embodiment of a metal processing converter.

BACKGROUND OF THE INVENTION

Converters, used in particular for preparing and refining steel by blowing air or oxygen into a molten metal bath, generally consist of an elongated vessel into which a liquid-metal bath to be treated, for example pig iron, is charged.

The vessel consists of a side wall, generally generated by revolution about an axis and defining a treatment space closed at one end by a bottom and opening out at its other end into a charging and casting orifice, the side wall and the bottom being covered by a refractory lining.

It is known that the vessel must be located in a vertical position for blowing of air or oxygen, and then tilted through rotation about a horizontal axis so that the metal can be cast after treatment. For this purpose, the vessel is located between two raised fixed supports on which it rests by means of two rotational-bearing members which are diametrically opposite to each other and centered on the same horizontal axis about which the vessel is able to pivot through the action of an operating means.

This type of apparatus, which has been known since the beginning of the metallurgical industry, has obviously been the subject of numerous improvements associated with progress in the art, and the method of supporting the vessel with respect to the rotating support members which define the tilting axis is particularly important because the behavior of the vessel and the support members and their performance over time depend on it, even more so since the mass of liquid metal treated during an operation and, consequently, the dimensions and the weight of the converter have become very important.

Generally speaking, the support members are subject, on the one hand, to the mechanical loads which depend on the intrinsic weight of the vessel and the refractory materials, the charge of molten metal and/or of scrap and the vibrations caused by treatment and, on the other hand, to the thermal stresses due to the temperature of the molten-metal charge inside the vessel, to the heat released by the blowing of air or oxygen during processing and to the radiation during deslagging or steel pouring.

To date, it has seemed obvious to construct, in the form of clearly separate members, on the one hand, the treatment vessel covered internally with a refractory lining so as to withstand the high temperatures due to treatment and, on the other hand, its support members which comprise, generally, a circular ring defining an orifice inside which the vessel may be inserted, bearing on the two fixed supports, by means of trunnions.

The tilting movement is applied onto the ring which rotates about its trunnions, causing the vessel to move as well. For this purpose, the tilting torque may advantageously be applied onto a rim with a fairly large diameter, which is keyed onto one of the trunnions and rotation of which is controlled by a speed-reducing unit (see FR-A-1,550,338). Such a rim, in the form of a cylindrical collar centered on the tilting axis, may also be mounted rotatably on rollers so as to serve as a bearing member for the ring (see FR-A-1,257,664).

The treatment, support and tilting functions are thus ensured by separate members, which consequently may be provided. For example, the ring may be cooled by circulating water, this not being possible in the case of the vessel. Moreover, so as to allow relative movements and expansion, the vessel is generally supported by the ring only at particular support points.

Such an embodiment is, however, very heavy and expensive since the ring must support not only the weight of the vessel, but also the torques due to pivoting. The actual weight of the ring may, moreover, be of the same order as that of the vessel.

Furthermore, the forces involved in supporting the vessel on the ring are delicately distributed in a manner which is rarely isostatic, so much so that differential stresses appear, the load distribution is disturbed and the stresses are unbalanced.

Generally, however, such an embodiment has apparently proved to be satisfactory and has therefore been widely used, it being possible to overcome its drawbacks by use of various mechanical or thermal devices. However, all these arrangements complicate installation, operation and maintenance thereof, increasing the cost without, however, eliminating all the problems.

SUMMARY OF THE INVENTION

The subject of the invention is a converter, which enables all these difficulties to be resolved in a satisfactory manner owing to a much simpler supporting method.

The invention therefore applies, generally, to a converter of the type comprising an elongated vessel located between two raised fixed supports and consisting of a hollow side wall centered on an axis and defining a treatment space closed at one end by a bottom, the assembly being covered internally with a refractory lining, rotational means for supporting the vessel comprising two rotational bearing members diametrically opposite to each other and consisting respectively of two cylindrical collars, the external surfaces of which form respectively two circular tracks centered on the same horizontal axis perpendicular to the axis of the vessel and bearing, respectively, against each fixed support by means of at least two rotating rollers separated from each other and means for effecting tilting of the vessel about the horizontal axis.

According to the invention, the two bearing collars form an integral part of the vessel and are directly fixed onto the side wall of the latter, each one along an internal circular edge, the diameter of the two collars being determined so that each internal edge is joined to the side wall over a length sufficient to absorb the stresses resulting from the forces applied during operation and differential expansion.

Generally, the diameter of each collar may be between a quarter and half the diameter of the vessel.

In a particularly advantageous embodiment, each collar is provided, in the region of the side wall of the vessel, with a series of openings regularly distributed around the axis and defining between them a series of flexible metal strips fixed onto the side wall at their inner ends facing the vessel.

So that the vertical forces may be effectively absorbed, each collar is mounted, preferably, on a series of gussets located inside the collar and oriented radially along planes passing through the axis of the collar, each gusset having two perpendicular sides fixed respectively onto the side wall of the vessel and onto the inner surface of the collar.

According to another advantageous arrangement, each support is provided with at least two counter-rollers for holding the collar in position, bearing against the latter on the side opposite the support rollers. These counter-rollers may be mounted on an annular frame surrounding the collar, bearing from the outside against the same circular track as the support rollers, at the top of the track. However, it is also possible to provide a second circular track on the inner surface of the collar, against which bear counter-rollers located in pairs opposite the support rollers located on the other side of the collar, all the rollers being mounted inside a frame which covers only the bottom part of the collar.

According to another feature, the rollers and the circular tracks have rounded shapes, which are convex and concave respectively, mutually cooperating so as to compensate alignment errors and any mechanical or thermal distortions, and to ensure lateral positioning of the track on the rollers.

Another advantage of the invention is that it simplifies the means effecting tilting of the vessel, by using one of the bearing collars as a drive ring operated by a tilting mechanism. For this purpose, use may be made of a circular flange which is fixed at its periphery onto one of the bearing collars and at the center of which is fixed a drive shaft centered on the tilting axis and connected via a speed-reducing mechanism to at least one motor for effecting tilting.

It is also possible for a toothed ring, engaging with one or more pinions driven in rotation, to be provided directly on one of the bearing collars or on an extension of the latter.

According to a known arrangement known in other applications, each pinion could be mounted inside a housing accommodating rollers rolling on circular tracks adjacent to the toothed ring so as to keep the pinion meshed with the latter.

In this way, as on the non-motorized side, the inside of the collar is entirely unobstructed, such that fluid pipes useful for the metallurgical process are able to pass through.

BRIEF DESCRIPTION OF THE DRAWINGS

Other characteristic features of the invention will emerge from the following description of certain embodiments provided by way of example and shown in the accompanying drawings.

DESCRIPTION OF RPEFERRED EMBODIMENTS

Figure 1:
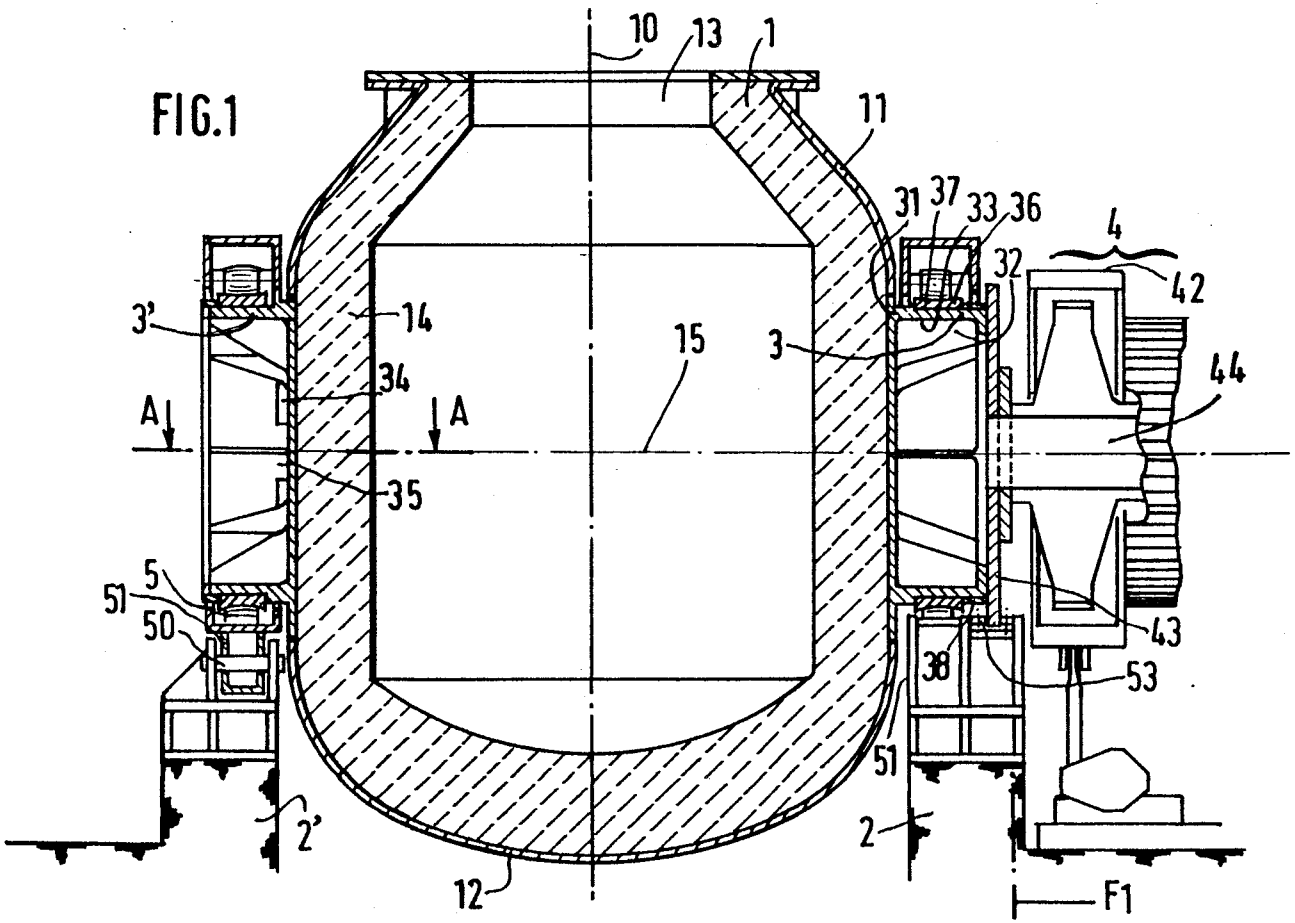
FIG. 1 is an overall elevation view of a converter according to the invention, sectioned along the plane passing through the axis of the vessel and the transverse tilting axis.

FIG. 1 shows, in elevation, a converter in its entirety, generally comprising a vessel 1 located between two supports 2 and 2' and resting on the latter by means of two rotationally bearing members 3 and 3' diametrically opposite to each other and centered on a horizontal axis 15 about which the vessel is able to rotate, through the action of a tilting drive mechanism 4, so as to first be directed upwards in order to charge the liquid metal and, if necessary, the scrap, as well as for the processing treatment, and then inclined downwards for casting the metal.

The vessel 1 consists of a side wall 11 generated by revolution about an axis 10 perpendicular to the tilting axis 15, which wall is closed at one end by a bottom 12 and opens out at its other end into an orifice 13. The side wall 11 generally has a cylindrical shape in its central part and becomes narrower at its open end so as to define the orifice 13. The whole of the side wall 11 and the bottom 12 is covered internally by a refractory lining 14.

Each bearing member consists essentially of a cylindrical collar 3, 3' centered on the transverse axis 15 and fixed directly onto the side wall 11 of the vessel 1.

The two bearing collars 3 and 3' form an integral part of the vessel 1, the side wall 11 of which is entirely free between the two collars 3, 3' since no supporting ring is required.

Each collar 3, 3' is fixed onto the side wall 11 of the vessel, along its circular edge 31 facing the latter, and the diameter of the collar must therefore be determined so that a joint is effected over a length sufficient to absorb the stresses resulting from the forces applied during operation and the differential expansion. Each collar will therefore have a diameter which is much larger than that of conventional trunnions and which may, for example, be of the order of one-half the diameter of the vessel.

Each bearing collar 3, 3' rests, along its outer surface 36, on a pair of support rollers 5 each rotatably mounted about an axis 50 parallel to the transverse axis 15 on a frame 51 itself fixed to the top of the support block 2, 2'.

Figure 2:
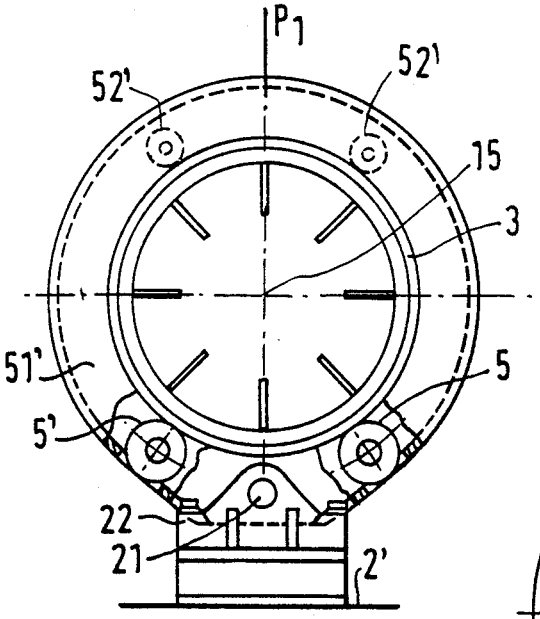
FIG. 2 and FIG. 3 are front views of the two bearing members located on either side of the vessel in the direction of the arrows F1 and F2 of FIG. 1, respectively.
Figure 3:
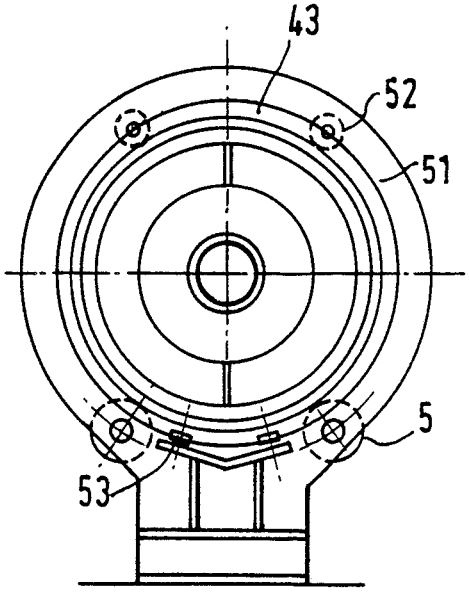

As can be seen in FIGS. 2 and 3, the two rollers 5 are located at a distance from each other, on either side of the center plane P1 of the vessel passing through the axis 10 of the vessel and the tilting axis 15, so as to provide a good seating.

So that the bearing forces are properly absorbed, the collar 3 is mounted on a series of gussets 32 oriented along radial planes passing through the axis 15 and regularly distributed around this axis and comprising two perpendicular sides fixed onto the inner surface 33 of the collar 3 and onto the side wall 11, respectively.

Figure 4:
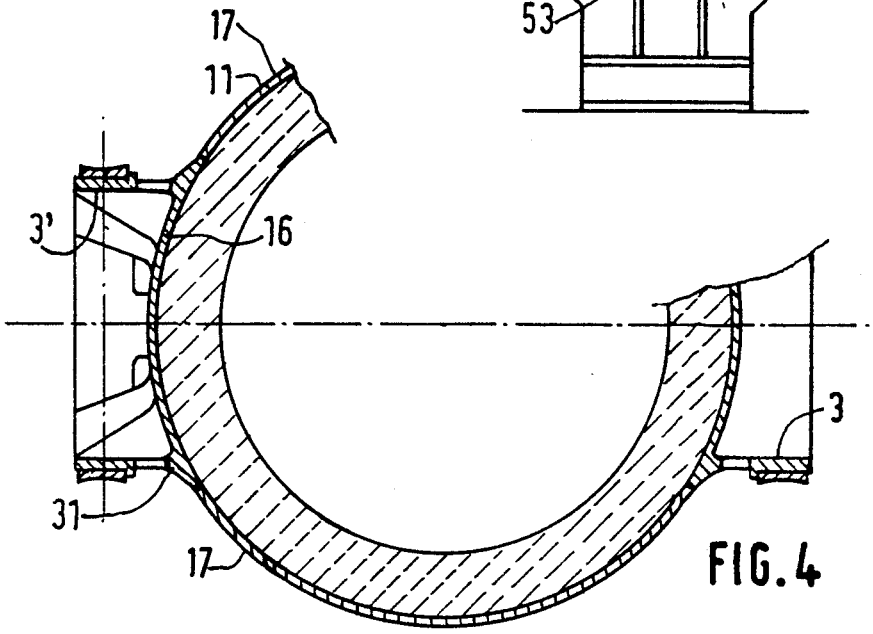
FIG. 4 is a detail view showing a bearing collar sectioned along a horizontal plane according to line A—A in FIG. 1.

As can be seen in FIG. 4, which is a sectional view along a horizontal plane, the side wall 11 of the vessel is entirely free on its two faces 17 located between the two bearing collars 3, 3', namely, in fact, over most of its periphery. On the other hand, in the arrangements used in the past, the side wall 11 was completely surrounded by the support ring which formed, together with the vessel attachment elements, screens capable of obstructing ventilation of the sheet steel of the vessel and of the ring. In the arrangement according to the invention, however, most of the vessel may be simply cooled by natural circulation.

Of course, relative expansion between the wall 11 of the vessel and the bearing collars cannot be avoided, but it is possible to calculate these stresses using simple methods and determine, consequently, the length and structure of the circular connection between each collar and the side wall.

Moreover, in order to allow relative expansion of the side wall 11 with respect to the collar 31, the latter may advantageously be provided with openings 34 separated from each other and distributed regularly along the collar 3 on the side facing the side wall 11, the collar 31 being, consequently, joined to the wall 11 only by spaced metal strips 35 left between the openings 34 and by the gussets 32 which are located in the center of the strips 35. The edge 31 of the collar 3 joining the side wall of the vessel therefore consists of the ends of the strips 35 pointing towards the vessel. Of course, the diameter of the collar 3, as well as the size and the number of the openings 34 must be determined so that, overall, the collar is joined to the side wall over a sufficient length.

The outer surface of each collar 3 therefore forms a circular track for rolling on the two support rollers 5, which advantageously may consist of a band 36 mounted or welded on the collar 31.

To ensure that each collar 3 is held in position on the pair of support rollers 5, the latter are associated with a pair of counter-rollers 52 bearing against the collar on the opposite side. For example, in the embodiment shown in FIG. 2, the rollers 5 are mounted on an annular frame 51' which surrounds the collar 3 with play and at the top of which the counter-rollers 52 are mounted, each rotating about an axis parallel to the transverse axis 15 and bearing against the same circular track as the support rollers 5, which track consists of the band 36. These rollers are applied with a controlled force so as to avoid vibrations, in particular during the processing phase.

Preferably, the rollers are provided with a convex side wall and the outer surface 37 of the band 36 has a corresponding concave shape, thereby enabling the rollers 5 and 52 to be centered on the track 36 the loads to be correctly distributed over the entire surface of the roller itself when the deformations of the vessel due to the stresses absorbed cause slight misalignment of the collars 3, the axis 15 being in this case slightly curved.

The means 4 for effecting tilting of the vessel comprise one or more motors associated with a speed-reducing mechanism 42. The use, according to the invention, of circular bearing members with a relatively large diameter simplifies the driving operation. In fact, the movement may be transmitted directly to the collar 3 of one of the bearing members 3 by means of a flange 43 fixed onto the circular edge 38 of the collar on the opposite side to the vessel 1. The speed-reducing mechanism 42 may, for example, be simply mounted in cantilever fashion on a drive shaft 44 integral with the flange 43 and centered on the axis 15.

Preferably, the flange 43 is held laterally between two pairs of rollers 53 mounted on the frame 51 supporting the rollers 5.

So as to ensure free deformation of all the elements under the action of the mechanical and thermal stresses absorbed, the second rotating bearing member, located on the opposite side to the drive mechanism 4, is arranged so as to be able to move slightly relative to these supports. In particular, the support rollers 5' and holding rollers 52' of the collar 3', shown in FIG. 2, may be slideably mounted on their axes so as to move laterally in the event of the diameter of the vessel increasing. Furthermore, as can be seen in FIG. 2, the annular frame 51' on which the rollers 5' and the counter-rollers 52' are mounted is hinged, about a horizontal spindle 21, with a clevis 22 fixed to the top of the support block 2'. The possibility of pivoting the frame is limited by springs (not shown) or by a torsional bar which spreads the loads over the two rollers.

Different embodiments may be applied to the invention. For example, in FIGS. 1 and 4, the bearing collars 3 and 3' are molded parts formed as a single piece with the gussets 32 and the corresponding part 16 of the side wall 11 of the vessel, which consists of a cylindrical wall portion defined by a circular edge with a diameter slightly greater than that of the collar 3 and which is welded along a circular orifice with the same diameter, provided on the side of the wall 11. In this case, the molded part 3 is calculated so as to withstand the forces absorbed and the circumference of the circular part 16 must be sufficient for the welded joint with the wall 11 to be able to absorb the stresses.

Figure 5:
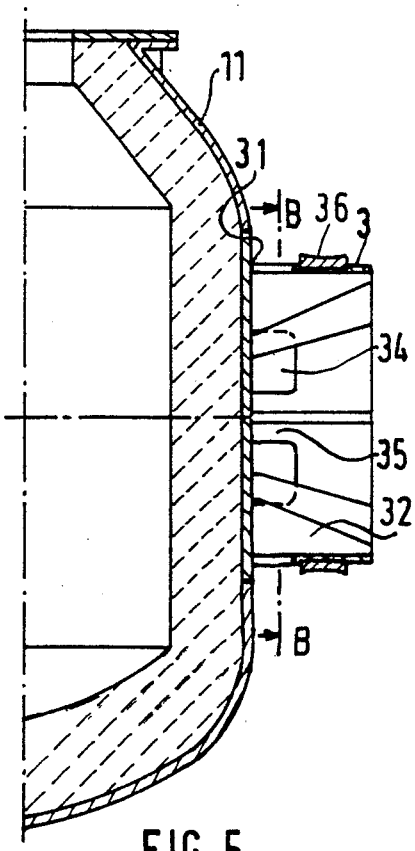
FIG. 5 is a partial elevation view of the vessel, showing another embodiment of the bearing collar.
Figure 6:
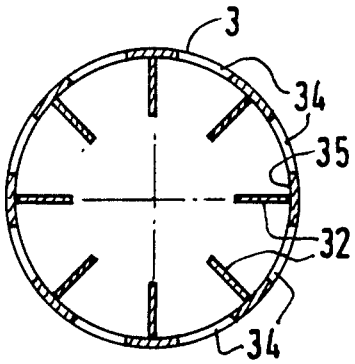
FIG. 6 is a sectional view of the collar along a plane perpendicular to its axis, according to line B—B of FIG. 5.

FIG. 5 shows a welded embodiment which in particular allows the side wall 11 of the vessel to be made in a homogeneous manner. The collar 3 is therefore a simple circular plate welded onto the wall 11, along its inner edge 31. It is therefore possible to provide the collar 3 with a greater possibility for deformation by making the collar wider, which results in the connecting strips 35 being made longer and the cross section of the openings 34 being increased, the bands 36 therefore being located further away from the side wall 11 than in the previous embodiment. Elongation of the connecting strips 35 increases the flexibility of the latter and, consequently, the capacity for the shape of the collar to be adapted to the stresses absorbed. Similarly, the assemblies with a T-shaped cross section, consisting of each strip 35 associated with a gusset 32, as shown in FIG. 6, are relatively independent of each other and are able to move according to the deformations of the collar 3.

Figure 7:
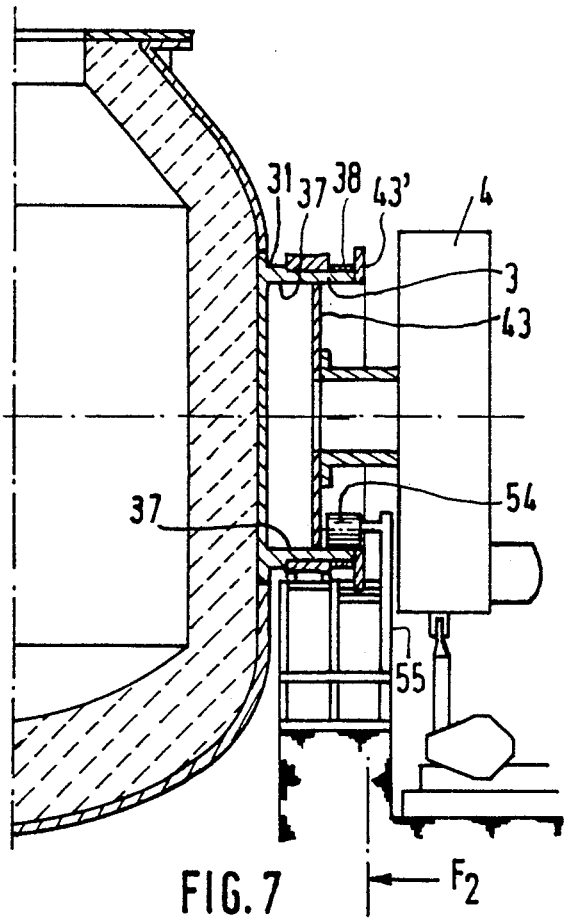
FIG. 7 is an overall elevation view showing another embodiment of the invention.
Figure 8:
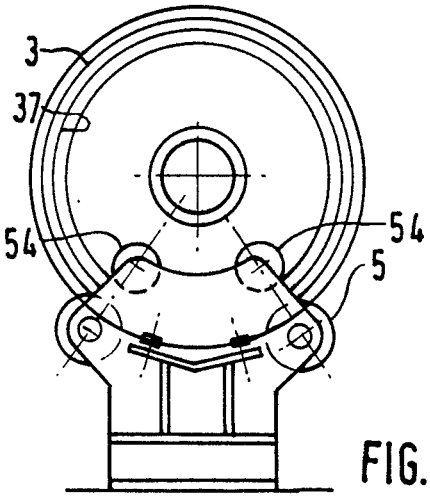
FIG. 8 is a front view of the bearing collar along the line F3 of FIG. 7.

In another embodiment, shown in FIGS. 7 and 8, the bearing collars 3 and 3, are supported in a more compact arrangement. In fact, the support rollers 5 are each associated with a counter-roller 54 located directly on the other side of the collar 3, i.e., on the inner surface 37 of the latter. The two pairs of rollers 5 and 54 can therefore be mounted on a small frame 55 which simply covers the bottom part of the collar 3.

As in the embodiment described above, the frame 55 supporting the rollers located in the region of the tilting mechanism is fixed and also supports guiding rollers 53 mounted rotatably on radially oriented axes and resting on either side of a side wall 43, which in this case, has an annular shape so as to allow the counter-rollers 54 to pass through; the flange 43 connected to the drive mechanism 4 is therefore set back and fixed onto the inner surface 37 of the collar 31.

On the opposite side to the mechanism, the support rollers 5' and the counter-rollers 54, are advantageously axially slidably mounted on the frame 51' and the latter, as described above with reference to FIG. 2, is itself mounted pivotably about a horizontal axis 21' on a clevis 22' fixed on top of the support block 2'.

Figure 9:
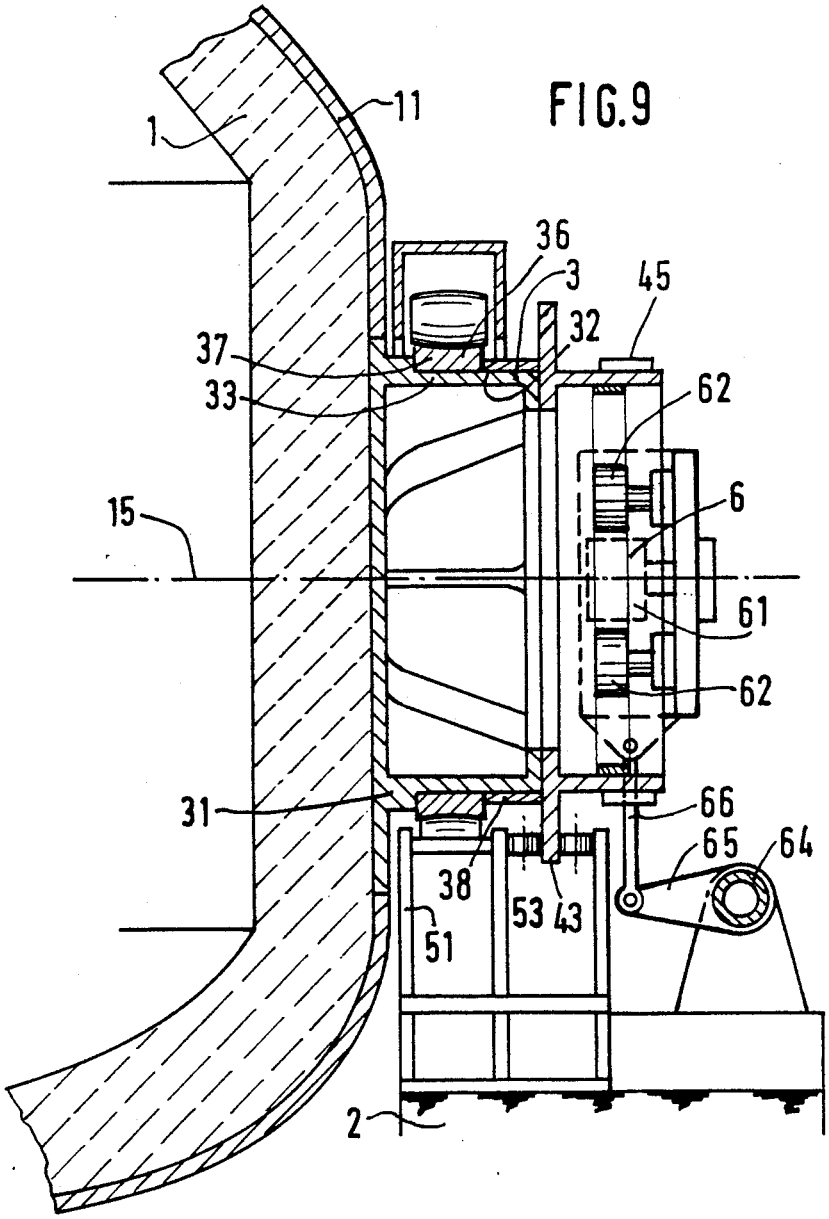
FIG. 9 is a partial elevation view, showing a another of embodiment of the tilting mechanism.

FIG. 9 shows in schematic form another particularly advantageous embodiment of the tilting mechanism. In this case, a toothed ring 45 has been directly provided on one of the bearing collars 3 or on an extension 30 of the latter, the tilting drive movement being directly applied to the toothed ring via one or more pinions driven in rotation.

As shown in FIG. 9, it is advantageous to use two pinions 6 located diametrically opposite each other and each mounted inside a housing 61 supported by one or more pairs of rollers 62 rolling on a track 63 provided on the inner surface of the collar extension 30.

The two housings 61 located diametrically opposite each other rest on a torsion bar 64, perpendicular to the plane of the figure, fixed onto the support block 2 and having at each end a cottered crank 65, each joined to the corresponding housing 61 by a connecting rod 66 hinged at its ends.

The two pinions may be driven by the same motor, for example by means of speed-reducing units mounted on each of the housings 61.

Other drive embodiments may be envisaged, for example that which forms the subject of French Patent No. 1,550,338 and which comprises two spaced pinions mounted inside a floating housing.

As a result of this arrangement, on the one hand the tilting torque can be applied over a large circle, reducing the shearing stresses, and, on the other hand, the entire inside of the collar can be left unobstructed, as on the non-motorized side, so that the various fluid pipes useful for the process can pass through it.

Other bearing systems or other known mechanisms for effecting tilting of the vessel, for example using several motors, could be adapted to the invention, thus adding their own advantages.

To summarize, the invention offers numerous advantages.

Elimination of the ring simplifies the structure, lightens the assembly and allows more effective cooling of the vessel which is no longer masked and enclosed underneath poorly ventilated covers.

As a result of the large diameter of the band formed by each collar, the bearing and tilting forces can be reduced and distributed over a larger portion of steel plate than in conventional systems. Furthermore, as a result of the possibility of deforming the bearing collars slightly and in particular the connection effected with the vessel by means of relatively flexible strips designed so as to withstand the various flexural, compressive and shearing forces, the vessel is able to expand in the axial and diametral direction under the action of thermal stresses.

Unlike conventional embodiments using an independent ring, the vessel can be supported isostatically since it is supported solely by two bearing members which are able to adapt to a certain degree to the distribution of the loads.

Moreover, the use of simple rollers to support the bands is less expensive, and easier to maintain than the bearings used hermetically to support the ladle trunnions.

Finally, the large diameter of the bearing collar means that a large space can be left free for the various fluid pipes required for the metallurgical processes.

I claim:

1. Converter comprising (a) an elongated vessel;

(b) two raised fixed supports respectively located on either side of said vessel;

(c) two means for rotatably supporting said vessel bearing respectively on said fixed supports, said rotatably supporting means being located diametrically opposite each other and centered on a same transverse axis perpendicular to an axis of said vessel;

(d) means for effecting tilting of said vessel about said transverse axis;

(e) each of said two means for rotatably supporting said vessel comprising a circular collar centered on said transverse axis and forming an integral part of said vessel fixed directly on a side-wall of said vessel;

(f) each said collar being provided on a side thereof facing said vessel with a plurality of openings regularly distributed around said transverse axis and respectively defining between them a plurality of strips having inner ends facing said vessel; said inner ends being directly fixed onto said side-wall of said vessel;

(g) the diameter of each said collar and the size and number of said openings being so determined that said collar is joined to said side-wall over a length sufficient for withstanding flexural, compressive and shearing forces and permitting deformations of said vessel.

2. Converter as claimed in claim 1, wherein each said rotatably supporting means comprises a circular track provided on an outer surface of said collar and bearing against a corresponding fixed support by means of at least two rotating support rollers separated from each other.

3. The converter as claimed in claim 1 or 2, wherein each said collar is mounted on supporting means comprising a series of gussets located inside said collar and radially oriented along planes passing through an axis of said collar, each gusset having two perpendicular sides fixed respectively onto said side-wall of said vessel and onto an inner surface of said collar.

4. The converter as claimed in claim 1, wherein each support (2) (2') is provided with at least two counter-rollers. (52, 54) for holding the collar (3) in position, bearing against the latter on the side opposite to the support rollers (5).

5. The converter as claimed in claim 4, wherein the support rollers (5) and the holding counter-rollers (52) are mounted on an annular frame (51) surrounding the collar (3) and wherein the counter-rollers (52) bear from the outside against the same circular track (36) as the support rollers (5), at the top of the latter.

6. The converter as claimed in claim 4, wherein the support rollers (5) and the holding counter-rollers (54) are located inside a frame (55) covering the bottom part of the collar (3), and wherein the counter-rollers (54) bear from the inside against a second circular track (37) provided on the inner surface (33) of the collar (3).

7. The converter as claimed in claim 5 or 6, wherein said support rollers and said counter-rollers (5, 52, 54) and associated circular track (36) (37) have respectively convex and concave rounded shapes mutually cooperating so as to position the track (36) (37) laterally on said support rollers and said counter-rollers (5) (52) (54).

8. The converter as claimed in claim 5, wherein the frame (51') carrying the support rollers (5, of the bearing of at least one collars (3') is mounted pivotably on the corresponding fixed support (2') about an axis parallel to the tilting axis (15) of the vessel (1).

9. The converter as claimed in any one of claim 1 or 2, wherein the means (4) for effecting tilting comprise a mechanism (42, 43) acting directly on one of the bearing collars (3).

10. The converter as claimed in claim 9, wherein the means for effecting tilting (4]comprise a circular flange (43) which is fixed at its periphery on one of the bearing collars (3) and at the center of which there is fixed a drive shaft (44) centered on the tilting axis (15) and connected by a speed-reducing mechanism (42) to at least one motor (41) for effecting tilting.

11. The converter as claimed in claim 9, wherein the means for effecting tilting (4) comprise a toothed ring (45) provided directly along one of the bearing collars (3) and on which there engages at least one pinion (6) driven by a motor for effecting tilting.

12. The converter as claimed in claim 11, wherein each drive pinion (6) is floatably mounted inside a housing (61) provided with means for keeping the said pinion in contact with the toothed ring (45).

13. The converter as claimed in claim 12, wherein the means (4) for effecting tilting comprise two pinions (6) each mounted inside a separate housing (61) and located symmetrically on either side of the vertical plane passing through the tilting axis and wherein the two housing (61) separately bear against the same torsion bar (64) which is perpendicular to the vertical plane of symmetry and onto which are fastened, by means of cotters, two cranks (65) each joined to one of the housings (61) by a connecting rod (66) hinged on the housing (61) and on the end of the crank (65).

14. The converter as claimed in claim 10 to wherein the bearing collar (3) connected to the tilting mechanism (4) is associated with fixed rollers (5) (52, 54) while opposite collar (3') is associated with rollers (5') (52';54') mounted slidably on their frame (51,) in the of the tilting axis (15) so as to move according to the expansion of the vessel (1) and the parts associated with the latter.

* * * * *